US005265736A

United States Patent [19]

Orr

[11] Patent Number: 5,265,736

[45] Date of Patent: Nov. 30, 1993

[54] APPARATUS FOR DISPLAYING EYEGLASS FRAMES

[76] Inventor: Tom Orr, 1300 Gulfview Woods La., Tarpon Springs, Fla. 34689

[21] Appl. No.: 985,381

[22] Filed: Dec. 4, 1992

[51] Int. Cl.[5] ..... A47F 7/00

[52] U.S. Cl. ..... 211/13; 248/902

[58] Field of Search ..... 211/13, 88; 248/902

[56] References Cited

U.S. PATENT DOCUMENTS

| | | | |
|---|---|---|---|
| 1,219,685 | 3/1917 | Wall | 248/902 X |
| 2,949,683 | 8/1960 | Glover | 211/13 |
| 3,259,348 | 7/1966 | Dann | 248/902 X |
| 3,519,138 | 7/1970 | Murray | 211/13 |
| 4,558,788 | 12/1985 | Grothaus | 211/13 |
| 4,787,520 | 11/1988 | Pearson | 211/13 |
| 5,011,027 | 4/1991 | Van Slett | 211/13 |

*Primary Examiner*—Alvin C. Chin-Shue

*Assistant Examiner*—Sarah A. Lechok

*Attorney, Agent, or Firm*—Joseph C. Mason, Jr.; Ronald E. Smith

[57] ABSTRACT

An apparatus for displaying eyeglass frames includes an elongate square channel-shaped base member that includes a flat bottom wall, a rear wall and a front wall. The rear and front wall are parallel to one another and accommodate therebetween the free ends of the temple pieces of a plurality of eyeglass frames that are positioned along the extent of the base member. The front wall has a greater height than the rear wall so that the temple pieces are maintained in a horizontal plane when the rear wall of the base member is secured to a vertical support surface. The spacing between the rear wall and the front wall is predetermined in accordance with the respective heights of the front and rear walls to prevent the free ends of the temple pieces from falling out.

6 Claims, 1 Drawing Sheet

APPARATUS FOR DISPLAYING EYEGLASS FRAMES

BACKGROUND OF THE INVENTION

1. Field of the Invention

This invention relates, generally, to display devices. More particularly, it relates to a display device for holding and displaying eyeglasses, sunglasses, reading glasses, or the frames thereof.

2. Description of the prior art

Some types of spectacles, also known as eyeglasses or glasses, are displayed with their lenses installed, e.g., sunglasses, whereas other types are usually displayed with no lenses therein, i.e., only the frames thereof are displayed.

Spectacles are sold in a variety of shops, from retail stores to opthamologist's offices. Their display is problematic because of their shape, i.e., two transversely spaced apart temple pieces are hingedly mounted to and extend orthogonally from opposite ends of a lens-holding base. When the temple pieces are folded, the frames occupy a relatively small space, but when the temple pieces are arrayed in their operative position, a single frame occupies a relatively large space. Some displays require that the temple pieces be folded, but most busy establishments prefer displays that allow the temple pieces to remain unfolded so that customers do not wear out the hinges thereof through repeated use.

Display devices that require folding of the temple pieces are shown in U.S. Pat. Nos. 1,492,113 to Welsh, 1,479,632 to Stevens, 3,123,208 to Barnum et. al., and Des. 113,402 to Schram. Devices where the temple pieces are not folded are disclosed in U.S Pat. Nos. 3,351,208 to Siegel and 4,157,760 to Wilson.

A common limitation of many of the heretofore patented display devices is that the devices themselves are provided in the form of space-occupying stands. Typically, the display stand is a free standing case that occupies valuable countertop space.

Another common display device is a pegboard-like apparatus that is mounted in spaced apart, parallel relation to a wall of the establishment selling spectacles; the free ends of the temples are simply inserted into the holes formed in the pegboard. However, the pegboards themselves require a considerable amount of work to install, and most establishments are not equipped to handle the installation chore. Moreover, additional means are required to support the lens-holding base means of each frame. These additional support means add to the cost of the display means and detract from the appearance of the merchandise.

What is needed, then, is a display apparatus that displays frames in their unfolded configuration, which can be installed in moments by unskilled personnel, and which requires no auxiliary parts to support the displayed merchandise. However, at the time the present invention was made, it was not obvious to those of ordinary skill in this art, in view of the art when considered as a whole, how the needed display device could be provided.

SUMMARY OF THE INVENTION

The longstanding but heretofore unfulfilled need for a frame display apparatus that does not occupy countertop space, that is easy to install, and that requires no additional parts, is now provided in the form of an elongate, square channel-shaped base member that is attached to a vertical support surface such as a wall or the front of a counter. The base member includes a flat bottom wall that is positioned in a horizontal plane when the novel device is in use, an upstanding back or rear wall having a first predetermined height mounted to said bottom wall along a rear edge thereof, and an upstanding front wall, parallel to said rear wall, having a second predetermined height mounted to said bottom wall along a forward edge thereof. An elongate strip of a cushioned, resilient material having a layer of adhesive thereon is fixedly secured to the rear side of the rear wall, and a flexible, removable adhesive cover overlies the adhesive before the device is ready for use. To use the device, the removable adhesive cover is peeled from the resilient material to expose the adhesive thereon, and the resilient material is pressed into position where desired. The installer merely needs to select a flat, reasonably clean vertical surface, peel the adhesive cover from the resilient material, and press the device to the selected vertical surface at a proper height while holding said device level.

The depth of the bottom wall of the novel base member is preselected so that the spacing between the forward and rearward upstanding walls is sufficient to receive therebetween the free ends of the temple pieces of a spectacles frame. The base member may be of any predetermined length, and a plurality of frames may be disposed along the length thereof in lateral relation to one another. Since a typical pair of eyeglasses is about six inches in width, a three foot long base member would accommodate six frames in side-by-side array.

The height of the rear Wall is less than the height of the front wall by a predetermined amount; this unique feature, in conjunction with the spacing between said front and rear walls, holds the eyeglass frames in cantilevered relation to the display apparatus in the absence of additional support members which would detract from the appearance of the frames. Moreover, the top edge of the rear wall is formed into a feather edge to facilitate entry of the temple pieces into the space between the forward and rearward walls of the base member.

The front surface of the forward wall may also be adapted to hold informative messages such as brand names, sales prices, and the like.

Thus it is seen that the primary object of this invention is to provide a spectacles frame display apparatus that has a simple yet elegant construction.

Another important object is to provide a display apparatus that requires no tools or special expertise to install.

Still another important object is to provide an apparatus that holds spectacle frames in an attractive manner, yet in the absence of support devices that detract from the appearance of the frames.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
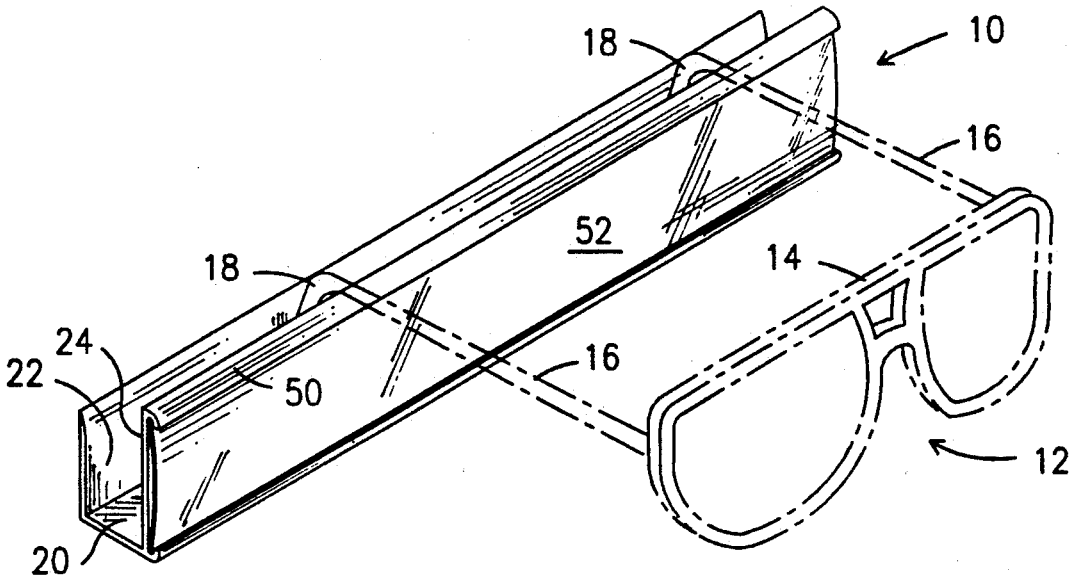
FIG. 1 a perspective view of an illustrative embodiment of the invention, showing the novel display device in truncated form.

Referring now to FIG. 1, it will there be seen that an exemplary embodiment of the present invention is denoted as a whole by the reference numeral 10. A spectacles frame is shown in phantom lines and is denoted 12 as a whole. Frame 12 includes a lens-holding base 14 and a pair of temple members, collectively denoted 16. The free ends of said temple members are collectively denoted 18.

Display device or base member 10 has the configuration of an elongate square channel as shown and includes flat bottom wall 20, upstanding rear wall 22 mounted along the rear edge of said bottom wall 20, and upstanding front wall 24 mounted along the forward edge thereof, in parallel relation to said rear wall.

Figure 2:
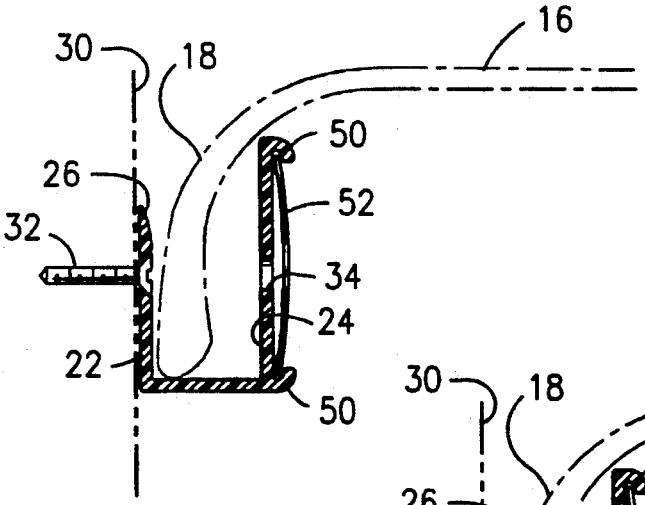
FIG. 2 a transverse sectional view of an embodiment where screws are employed to fasten the device to a vertical support surface.
Figure 3:
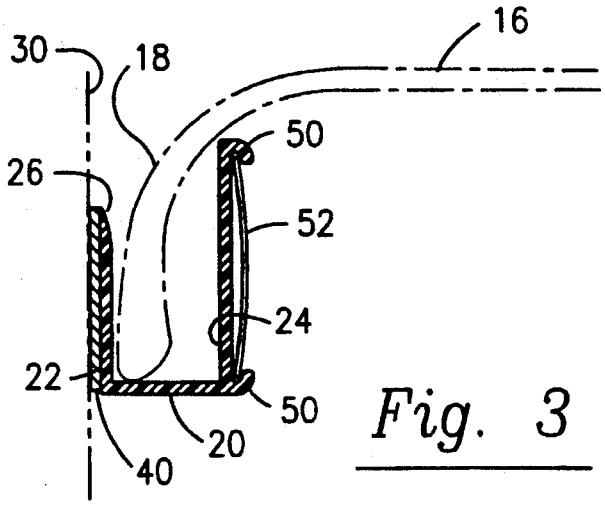
FIG. 3 is a transverse sectional view of an embodiment where an adhesive means is employed to fasten the display device to a vertical support surface.

As perhaps best shown in FIGS. 2 and 3, rear wall 22 has a predetermined height that is less than the predetermined height of front wall 24. This unique feature of base member 10, and the spacing between said front and rear walls, holds each temple piece 16 in a horizontal disposition, as depicted in said Figs., when the free ends 18 thereof are fully received within the square channel.

The uppermost edge of rear wall 22 is denoted 26; it has a feather edge as shown. This feature guides the free ends of the temples into the square channel; if said uppermost edge 26 is flat or unbeveled, said free ends will tend to abuttingly engage such flat surface and prevent facile entry of said temple free ends into the square channel when the frames are casually returned to the display device after trying them on. Typically, the free ends of the temples will first scrape against the vertical support surface to which the display device 10 is mounted when the frames are returned to said device; the feather edge thus serves as a ramp from said vertical support surface into the square channel.

The vertical support surface to which base member 10 is fixedly secured by any suitable means is denoted 30. It should be understood from FIG. 2 that rear wall 22 may be provided with a plurality of longitudinally spaced apart apertures along its extent, and a screw 32 may extend through each of said apertures and fixedly secure base member 10 to said vertical support surface 30. If this embodiment of the invention is selected, a second plurality of access apertures 34 are formed in front wall 24 in cooperative relation to each aperture formed in said rear wall so that a screwdriver may engage the screws therethrough.

The preferred embodiment is depicted in FIG. 3; no tools are required to install it. A thick, cushioned, resilient material 40 is permanently secured to the rear surface of rear wall 22, and a thin layer of adhesive is applied to the exposed side of said material. A flexible cover, not shown, overlies said adhesive, but is easily peeled therefrom to expose said thin layer of adhesive when the base member 10 is to be installed. When the base member 10 is purchased by the consumer, material 40, the thin layer of adhesive, and the cover are already assembled to one another and to said base member. Thus, the installer merely needs to peel away the cover and position the base member on a support surface in the manner described summarily above.

Lip members, collectively denoted 50, may be formed along the longitudinal extent of the upper and lower edges of front wall 24, and an elongate signboard 52 made of any suitable material may be slideably received therebetween. "Frames by Anthony Martin," "All frames $50.00," and similar messages may be displayed on said signboard. Since prices and advertising messages change frequently, this feature is important; it provides a practical flexibility not available in pegboard and other frame displays.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A display apparatus for displaying eyeglass frames, comprising:

holding means for accommodating and holding the free ends of the temple pieces of an eyeglass frame;

said holding means including means for maintaining said temple pieces in a substantially horizontal plane when said holding means is in operation;

an elongate, flat bottom wall having a forward edge and a rearward edge;

said elongate, flat bottom wall having a predetermined depth;

an elongate rear wall mounted to said rearward edge;

an elongate front wall mounted to said forward edge in parallel relation to said rear wall;

said elongate rear wall and said elongate front wall being spaced apart from one another by an amount determined by said said bottom wall, rear wall, and front wall collectively forming a square-shaped channel;

said elongate rear wall having a predetermined height less than a predetermined height of said elongate front wall;

said square-shaped channel accommodating and holding the free ends of temple pieces of eyeglass frames positioned therewithin, thereby providing said holding means; and said difference in height between said elongate rear wall and said elongate front wall, and the amount of said spacing between said elongate rear and front walls, providing said means for maintaining said temple pieces in a substantially horizontal plane;

whereby a plurality of eyeglass frames are displayed in cantilevered relation to said apparatus, each frame being supported only at the free ends of its associated temple pieces in the absence of auxiliary support members.

2. The apparatus of claim 1, further comprising securing means for securing said apparatus to a vertical support surface.

3. The apparatus of claim 2, wherein said securing means comprises an adhesive means fixedly secured to a rear surface of predetermined depth of said bottom wall; said rear wall so that said rear wall may be adhered to said vertical support surface.

4. The apparatus of claim 3, wherein said adhesive means includes a resilient, cushioned material that is fixedly secured to a rear surface of said rear wall, a thin layer of adhesive disposed in overlying relation to an exposed, rear surface of said resilient, cushioned material, and a flexible, removable cover means disposed in overlying relation to said thin layer of adhesive so that said apparatus is installed by peeling away said removable cover means to expose said thin layer of adhesive, followed by pressing said resilient, cushioned material onto a preselected vertical support surface.

5. The apparatus of claim 2, wherein said securing means includes a plurality of longitudinally spaced apart screw members that fasten said rear wall to said vertical support surface.

6. The apparatus of claim 1, wherein said rear wall has a feather edge formed in an uppermost edge thereof to guide the free ends of said temple pieces into said square-shaped channel.

* * * * *